US007040877B2

(12) United States Patent
Bergman et al.

(10) Patent No.: US 7,040,877 B2
(45) Date of Patent: May 9, 2006

(54) COMPRESSOR VALVE PLATE

(75) Inventors: Ernest R. Bergman, Yorkshire, OH (US); Scott D. Schulze, Troy, OH (US); Brad A. Schulze, Minster, OH (US)

(73) Assignee: Copeland Corporation, Sidney, OH (US)

( * ) Notice: Subject to any disclaimer, the term of this patent is extended or adjusted under 35 U.S.C. 154(b) by 250 days.

(21) Appl. No.: 10/374,385

(22) Filed: Feb. 25, 2003

(65) Prior Publication Data

US 2004/0166006 A1 Aug. 26, 2004

(51) Int. Cl.
*F04B 39/10* (2006.01)

(52) U.S. Cl. ..... 417/567; 417/571

(58) Field of Classification Search ..... 417/569, 417/567, 571, 531, 538, 539; 137/512, 543.19
See application file for complete search history.

(56) References Cited

U.S. PATENT DOCUMENTS

| | | | | |
|---|---|---|---|---|
| 886,045 | A | | 4/1908 | Ehrlich |
| 1,834,589 | A | | 12/1931 | Holdsworth |
| 1,852,033 | A | | 4/1932 | Summers |
| 2,996,155 | A | | 8/1961 | Priesemuth |
| 4,193,424 | A | | 3/1980 | Hrabal |
| 4,368,755 | A | | 1/1983 | King |
| 4,445,534 | A | * | 5/1984 | King ..... 137/512.3 |
| 4,469,126 | A | | 9/1984 | Simpson |
| 4,470,774 | A | * | 9/1984 | Chambers ..... 417/567 |
| 4,478,243 | A | | 10/1984 | King |
| 4,543,989 | A | | 10/1985 | Lorson |
| 4,548,234 | A | | 10/1985 | Prenger |
| 4,642,037 | A | | 2/1987 | Fritchman |
| 4,643,139 | A | | 2/1987 | Hargreaves |
| 4,696,263 | A | | 9/1987 | Boyesen |
| 4,729,402 | A | | 3/1988 | Blass et al. |
| 4,875,503 | A | | 10/1989 | Heger et al. |
| 5,016,669 | A | * | 5/1991 | Jamieson ..... 137/512 |
| 5,022,833 | A | * | 6/1991 | Kandpal et al. ..... 417/571 |
| 5,192,200 | A | | 3/1993 | Lilie et al. |
| 5,213,125 | A | | 5/1993 | Leu |
| 5,277,556 | A | | 1/1994 | van Lintel |
| 5,934,305 | A | | 8/1999 | Cho |
| 6,044,862 | A | * | 4/2000 | Schumann et al. ..... 137/512 |
| 6,164,334 | A | | 12/2000 | Wallis |

* cited by examiner

*Primary Examiner*—Charles G. Freay
(74) *Attorney, Agent, or Firm*—Harness, Dickey & Pierce, P.L.C.

(57) ABSTRACT

A valve plate assembly includes an upper valve plate, a lower valve plate, an annular spacer and a center spacer. The annular spacer is located between the upper and lower valve plates and around the outer periphery of the upper and lower valve plates. The center spacer is located at approximately the geometric center of the valve plate assembly to provide additional support for the valve plate assembly.

11 Claims, 5 Drawing Sheets

COMPRESSOR VALVE PLATE

FIELD OF THE INVENTION

The present invention relates generally to refrigeration compressors. More particularly, the present invention relates to a reciprocating piston type refrigeration compressor which incorporates a unique design for the valve plate assembly which improves the clamping characteristics of the valve plate gasket and thus improves the sealing of the valve plate gasket.

BACKGROUND AND SUMMARY OF THE INVENTION

Reciprocating piston type compressors typically employ suction and discharge pressure actuated valving mounted onto a valve plate assembly which is located at the end of a cylinder formed by a compressor body. The valve plate assembly is typically sandwiched between a compressor head and the compressor body. A valve plate gasket is located between the valve plate assembly and the compressor body to seal the interface.

Traditionally, the valve plate gasket is compressed due to a clamping load which is created by the attachment of the compressor head to the compressor body. The compressor head is attached to the compressor body by head bolts which extend through the compressor head, through the head gasket, through the valve plate assembly through the valve plate gasket and finally threadingly received by the compressor body. As these head bolts are tightened, compression of the valve plate gasket occurs.

Typically, the head bolts are located around the outside perimeter of the compressor head, the valve plate assembly and the valve plate gasket. Thus, the valve plate gasket receives most of its clamping load from this outside perimeter. Because the clamping load is generated at the outside perimeter of the valve plate gasket, there is a lower clamping load and thus a lower amount of compression of the valve plate gasket in the center portion of the valve plate gasket spaced from the outside perimeter. Because of this lower amount of compression of the valve plate gasket in the center portion, most of the valve plate gasket failures occur in this center portion.

In addition to compression of the valve plate gasket by the head bolts, valve plate gasket compression load is also created by the high pressure discharge gas located above the valve plate assembly. This high pressure discharge gas presses the valve plate assembly against the valve plate gasket and the compressor body. Typically the valve plate assembly is comprised of an upper valve plate, a lower valve plate and one or more spacers located between the upper and lower valve plates. In the center area of the valve plate assembly, there is no head bolt as described above and thus there is no spacer which creates an open void due to the lack of a spacer between the upper and lower valve plates. This means that the load, exerted by the high pressure discharge gas, is exerted on the upper valve plate and this exerted pressure is not transmitted directly to the lower valve plate in this center portion.

The present invention provides the art with a unique valve plate assembly which improves the valve gasket clamping load in the center portion and thus it significantly reduces valve gasket failures. The unique valve plate assembly of the present invention includes a center spacer which is located between the upper and lower valve plates in the center portion of the valve plate assembly. By incorporating this additional center spacer, the valve plate assembly exerts an increased clamping force in this center portion to increase the compression of the valve plate gasket and thus improve its performance and durability.

In the first embodiment of the present invention, the center spacer defines a bolt hole which extends through the spacer. A center bolt is assembled through the valve plate assembly using this bolt hole and it is threadingly received by the compressor body. When this center bolt is tightened, it provides additional clamping load to the valve plate gasket in the center portion to produce a more even clamping load throughout the entire valve plate gasket to improve performance and durability while reducing failures. The center bolt can extend only through the valve plate assembly and through the valve plate gasket into the compressor body or the center bolt can extend through the compressor head, through the valve plate assembly and through the valve plate gasket into the compressor body if desired.

In another embodiment of the present invention, the center spacer does not include the bolt hole. The center spacer is located within the center portion of the valve plate assembly to transmit both the clamping load and the pressure exerted by the high pressure discharge gas from the upper valve plate, to the lower valve plate, to the valve plate gasket and finally to the compressor body. This additional load exerted onto the valve plate gasket at its center portion increases the compression of the gasket at the center portion to produce a more even clamping load throughout the entire valve plate gasket to improve performance and durability while reducing failures. This additional embodiment is useful when it is not possible to assemble a center bolt due to a compressor unloader system or other features of the compressor being located at a position which limits access to the center portion of the valve plate assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
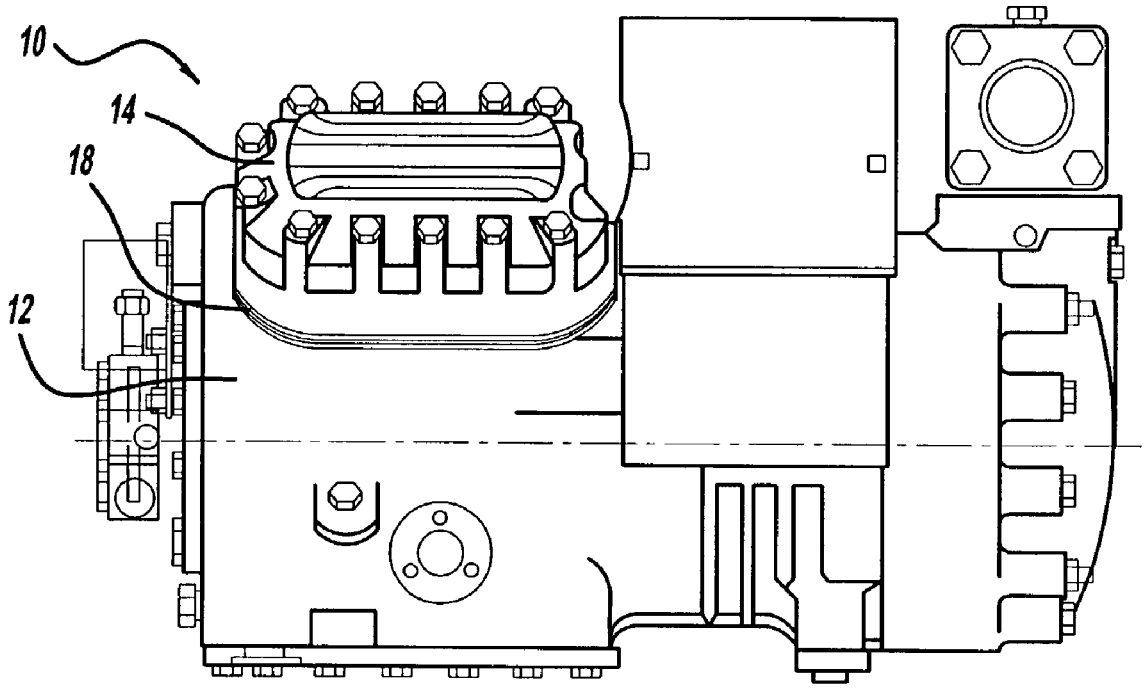
FIG. 1 is a side view of a compressor assembly incorporating the unique valve plate assembly in accordance with the present invention.
Figure 2:
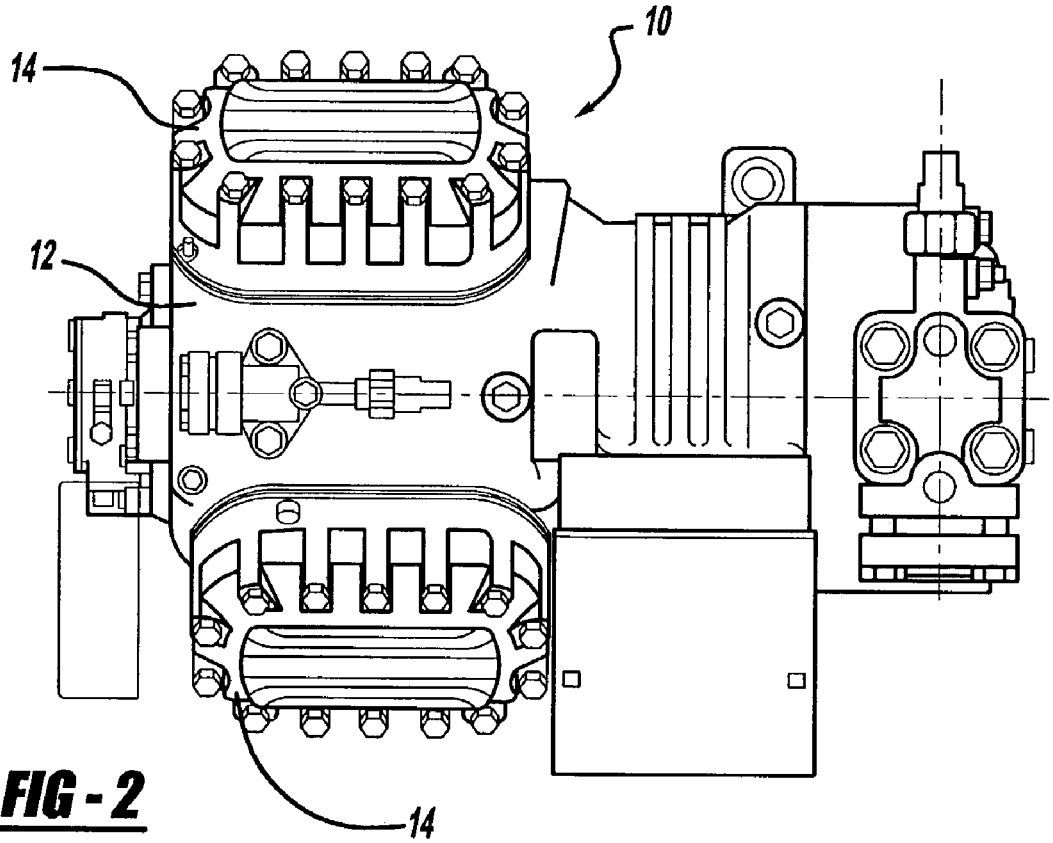
FIG. 2 is a top view of the compressor assembly illustrated in FIG. 1.
Figure 3:
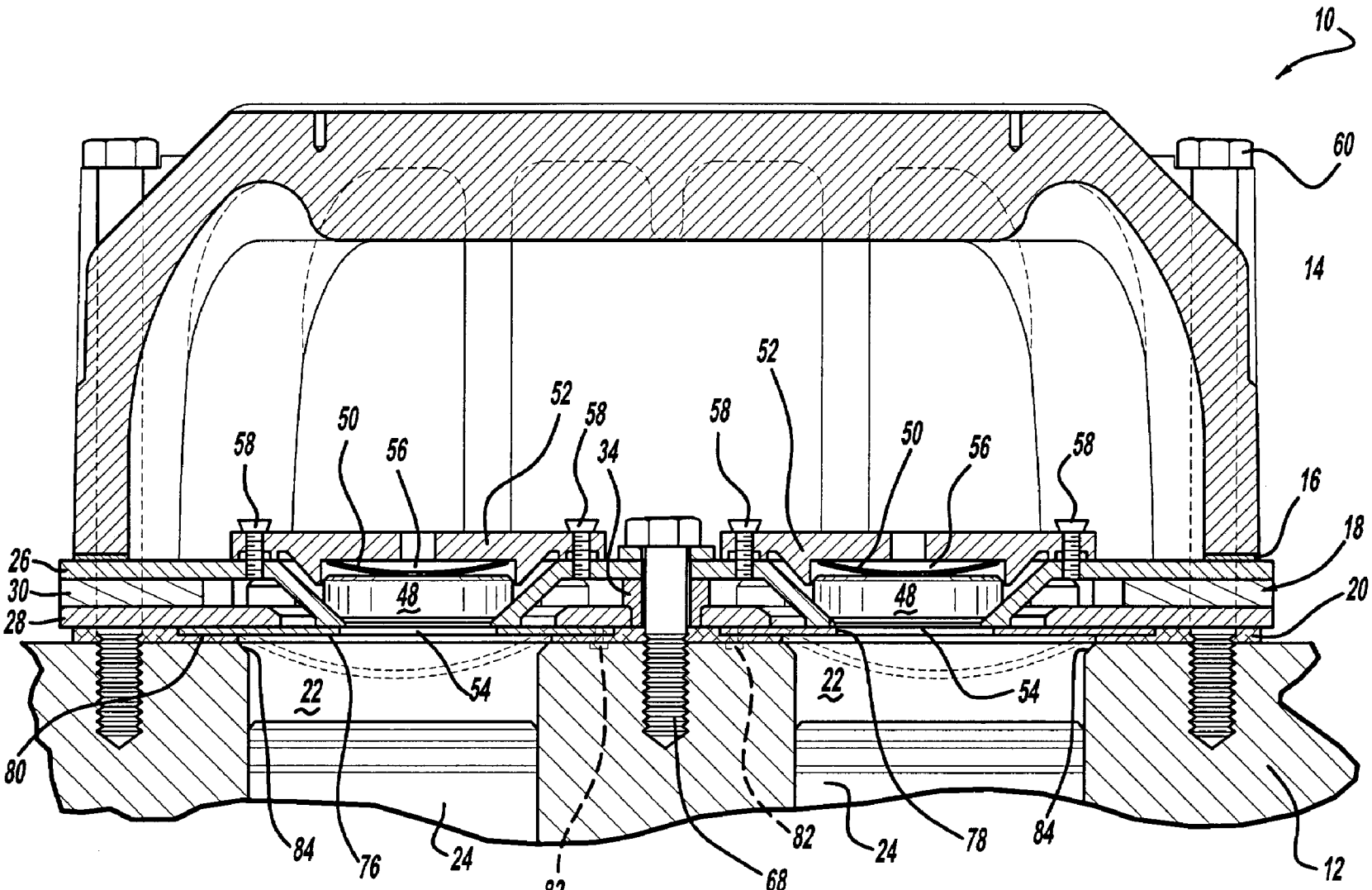
FIG. 3 is a partial cross-sectional view through the compressor assembly illustrated in FIGS. 1 and 2 where each cylinder is shown rotated 90° about a central axis.

The following description of the preferred embodiment(s) is merely exemplary in nature and is in no way intended to limit the invention, its application, or uses. There is shown in FIGS. 1–5 and compressor assembly 10 which incorporates the unique valve plate assembly in accordance with the present invention. Compressor assembly 10 comprises a compressor body 12, a compressor head 14, a head gasket 16, a valve plate assembly 18 and a valve plate gasket 20.

Compressor body 12 defines a pair of compression cylinders 22 within which a piston 24 is slidably disposed. Each compression cylinder 22 is in communication with both a discharge chamber and a suction chamber through valve plate assembly 18.

Valve plate assembly 18 comprises an upper valve plate 26, a lower valve plate 28, an annular spacer 30 a plurality of interior spacers 32 and a center spacer 34. Valve plate assembly 18 defines a pair of suction passages 36 which are in communication with the suction chamber of compression assembly 10 and a pair of discharge passages 38 which are in communication with the discharge chamber of compressor assembly 10. Each discharge passage 38 is defined by a radially inclined or beveled sidewall 40 extending between an upper surface 42 and a lower surface 44 of valve plate assembly 18. Beveled sidewall 40 is formed from upper valve plate 26. A surface 46 of beveled sidewall 40 provides a valve seat for a discharge valve member 48 which is urged into sealing engagement therewith by discharge gas pressure and a spring 50 extending between discharge valve member 48 and a bridge-like retainer 52.

As shown, discharge valve member 48 is of a size and a shape relative to discharge passage 38 so as to place a lower surface 54 thereof in substantially coplanar relationship to lower surface 44 of valve plate assembly 18. Spring 50 is located in a recess 56 provided in retainer 52. Discharge valve member 48 is essentially pressure actuated and spring 50 is chosen primarily to provide stability and also to provide an initial closing bias or preload to establish an initial seal. Other types of springs, other than that illustrated may of course be used for this purpose. Retainer 52, which also serves as a stop to limit the opening movement of valve member 48 is secured to valve plate assembly 18 by a pair of suitable fasteners 58.

Figure 4:
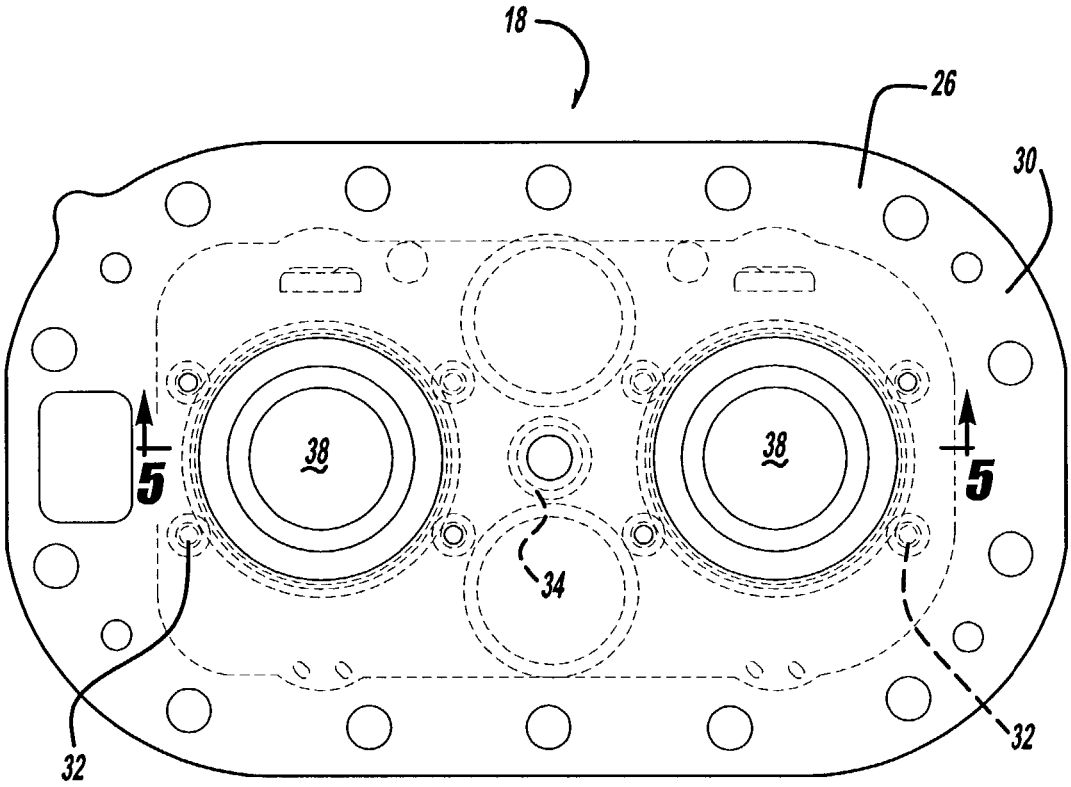
FIG. 4 is a top plan view of the unique valve plate assembly illustrated in FIG. 1–3.
Figure 5:
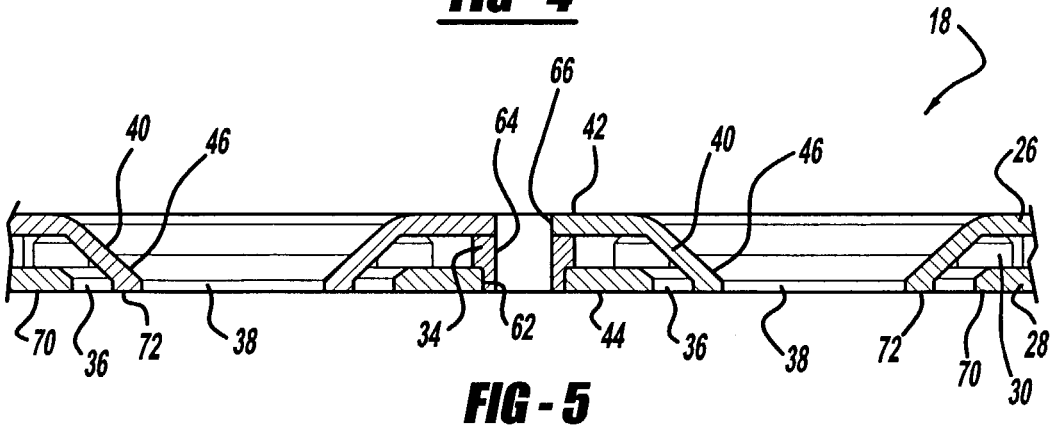
FIG. 5 is a side cross-sectional view of the unique valve plate assembly illustrated in FIG. 4.

Annular spacer 30 is disposed between upper valve plate 26 and lower valve plate 28 and annular spacer 30 forms suction passage 36 with upper valve plate 26 and lower valve plate 28. The plurality of interior spacers 32 are positioned around each compression cylinder 22 as illustrated in FIG. 4. Valve plate assembly 18 is secured to compressor body 12 when compressor head 14 is secured to compressor body 12. Valve plate assembly 18 is sandwiched between compressor head 14 and compressor body 12 with valve plate gasket 20 being sandwiched between valve plate assembly 18 and compressor body 12 and head gasket 16 being sandwiched between valve plate assembly 18 and compressor head 14.

A plurality of bolts 60 extend through compressor head 14, head gasket 16, upper valve plate 26 of valve plate assembly 18, annular spacer 30 of valve plate assembly 18, lower valve plate 28 of valve plate assembly 18, valve plate gasket 20 and are threadingly received by compressor body 12. The tightening of bolts 60 compresses valve plate gasket 20 to provide a sealing relationship between valve plate assembly 18 and compressor body 12 provide a sealing relationship between valve plate assembly 18 and compressor head 14. As shown in the Figures, the plurality of bolts 60 and annular spacer 30 of valve plate assembly 18 are located around the outer circumferential portion of compressor head 14 and valve plate assembly 18. In the prior art, the plurality of bolts 60 extending through compressor head 14, head gasket 16, valve plate assembly 18, valve plate gasket 20 and threadingly received by compressor body 12 were the only mechanical means for providing a compressive load to valve plate gasket 20. While this compressive load was sufficient for the outer circumferential portion of valve plate gasket 20 the center portion of valve plate gasket 20 would see less of a compressive load than the outer circumferential portion due to the distance between the center portion and each of the plurality of bolts 60.

The present invention improves the compressive characteristics of valve plate gasket 20 and thus its performance and durability by adding center spacer 34. Center spacer 34 is located at approximately the geometric center of valve plate assembly 18 at a position which is on a line which extends between the geometric center of one compression cylinder 22 and the geometric center of an adjacent compression cylinder 22. This places center spacer 34 generally midway between both the length and width of valve plate assembly 18. Center spacer 34 extends between upper valve plate 26 and lower valve plate 28 and is received within a bore 62 defined by lower valve plate 28. While illustrated as being received in bore 62 in lower valve plate 28, bore 62 could be located in upper valve plate 26 and center spacer 34 could be reversed from what is illustrated if desired. Center spacer 34 defines a through hole 64 which is aligned with a hole 66 extending through upper valve plate 26. A center bolt 68 extends through hole 66 of upper valve plate 26, through hole 64 of center spacer 34 and is threadingly received in compressor body 12. The tightening of center bolt 68 provides additional compressive load for valve plate gasket 20 at the center of valve plate gasket 20 to increase the compression of valve plate gasket 20, to produce a more even clamping load throughout the entire valve plate gasket 20 and to improve both the performance and durability of its sealing function.

Valve plate assembly 18 further defines an annular valve seat 70 and sidewall 40 defines an annular valve seat 72 located at its terminal end. Disposed between valve seat 70 and valve seat 72 is suction passage 36.

Valve seat 72 of sidewall 40 is positioned in coplanar relationship with valve seat 70 of valve plate assembly 18. A suction reed valve member 76 in the form of an annular ring sealingly engages, in its closed position, valve seat 72 of sidewall 40 and valve seat 70 of valve plate assembly 18 to prevent passage of fluid from compression cylinder 22 into suction passage 36. A central opening 78 is provided in suction reed valve member 76 and is arranged coaxially with discharge passage 38 so as to allow direct fluid flow communication between compression cylinder 22 and lower surface 54 of discharge valve member 48. Suction reed valve member 76 also includes a pair of diametrically opposed radially outwardly extending tabs 80. One tab 80 is used to secure reed valve member 76 to valve plate assembly 18 using a pair of drive studs 82.

As piston 24 within compression cylinder 22 moves away from valve plate assembly 18 during a suction stroke, the pressure differential between compression cylinder 22 and suction passage 36 will cause suction reed valve member 76 to deflect inwardly with respect to compression cylinder 22, to its open position (shown in dashed lines in FIG. 3), thereby enabling gas flow from suction passage 36 into compression cylinder 22 between valve seats 70 and 72.

Because only tabs 80 of suction reed valve member 76 extend outwardly beyond the sidewalls of compression cylinder 22, suction fluid flow will readily flow into compression cylinder 22 around substantially the entire inner and outer peripheries of suction reed valve member 76. As a compression stroke of piston 24 begins, suction reed valve member 76 will be forced into sealing engagement with valve seat 70 and valve seat 72. Discharge valve member 48 will begin to open due to the pressure within compression cylinder 22 exceeding the pressure within discharge passage 38 and the force exerted by spring 50. The compressed gas will be forced through central opening 78, past discharge valve member 48 and into discharge passage 38. The concentric arrangement of valve plate assembly 18 and reed valve member 76 allow substantially the entire available surface area overlying compression cylinder 22 to be utilized for suction and discharge valving and porting, thereby allowing maximum gas flow both into and out of compression cylinder 22.

The continuous stroking of piston 24 within compression cylinder 22 continuously causes suction reed valve member 76 and discharge valve member 48 to move between their open and closed positions. Compressor body 12 includes an angled or curved portion 84 at the outer edge of compression cylinder 22 adjacent the free end of suction reed valve member 76 to provide a friendly surface for suction reed valve member 76 to bend against, thereby significantly reducing the bending stresses generated within the free end tab 80.

Figure 6:
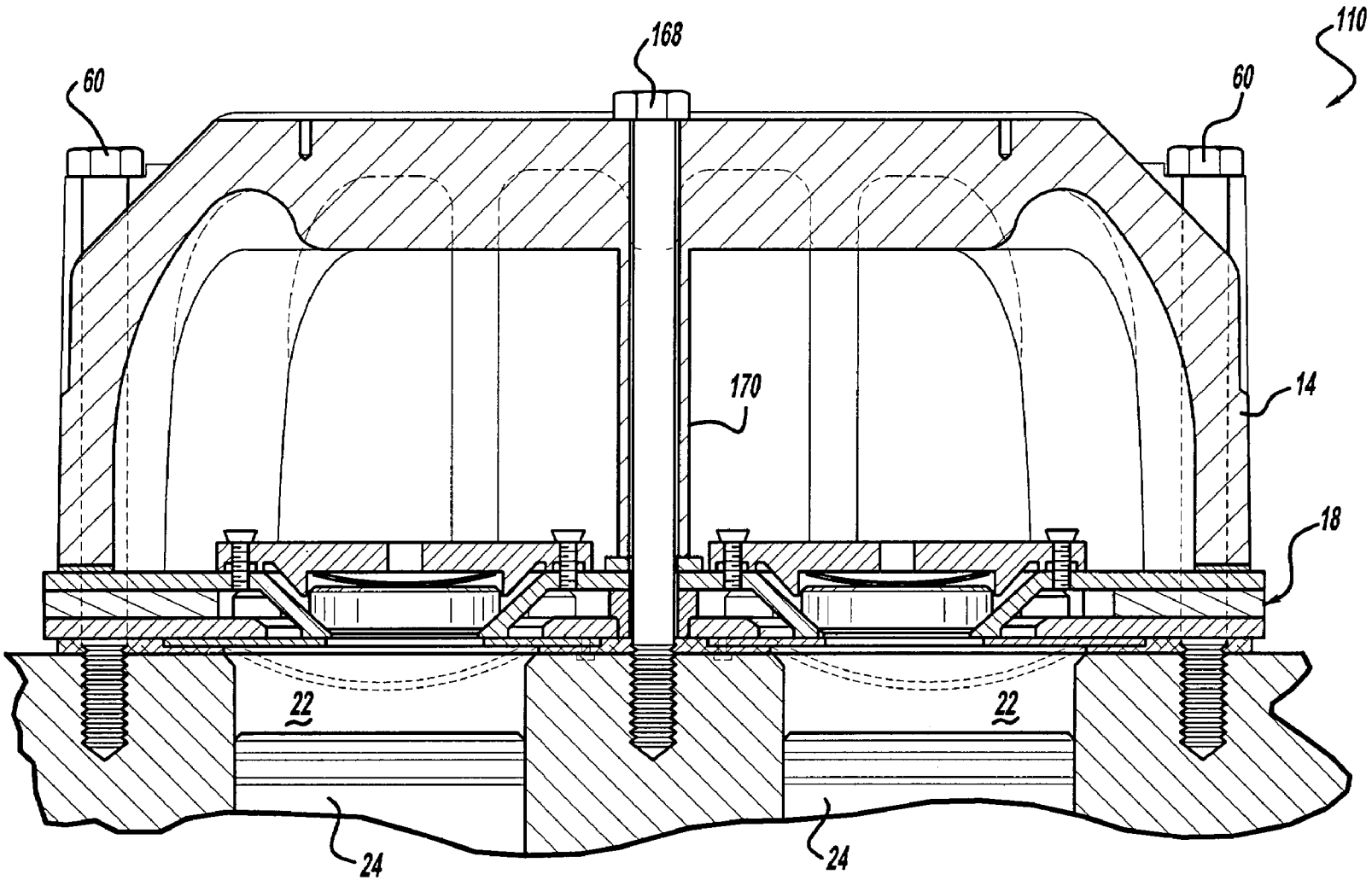
FIG. 6 is a partial cross-sectional view similar to FIG. 3 through a compressor assembly in accordance with another embodiment of the present invention.

Referring now to FIG. 6, a compressor assembly 110 in accordance with another embodiment of the present invention is illustrated. The embodiment illustrated in FIG. 6 is the same as the embodiment illustrated in FIG. 3 except that center bolt 68 has been replaced by center bolt 168. Center bolt 68 extended through valve plate assembly 18 and valve plate gasket 20 and was threadingly received by compressor body 12. Center bolt 168 illustrated in FIG. 6 extends through cylinder head 14, valve plate assembly 18 and valve plate gasket 20 and is threadingly received by compressor body 12. In order to exert the addition compressive loads, an extension 170 is added to cylinder head 14 through which center bolt 168 extends. The operation, function and features of compressive assembly 110 are the same as those described above for compressor assembly 10.

Figure 7:
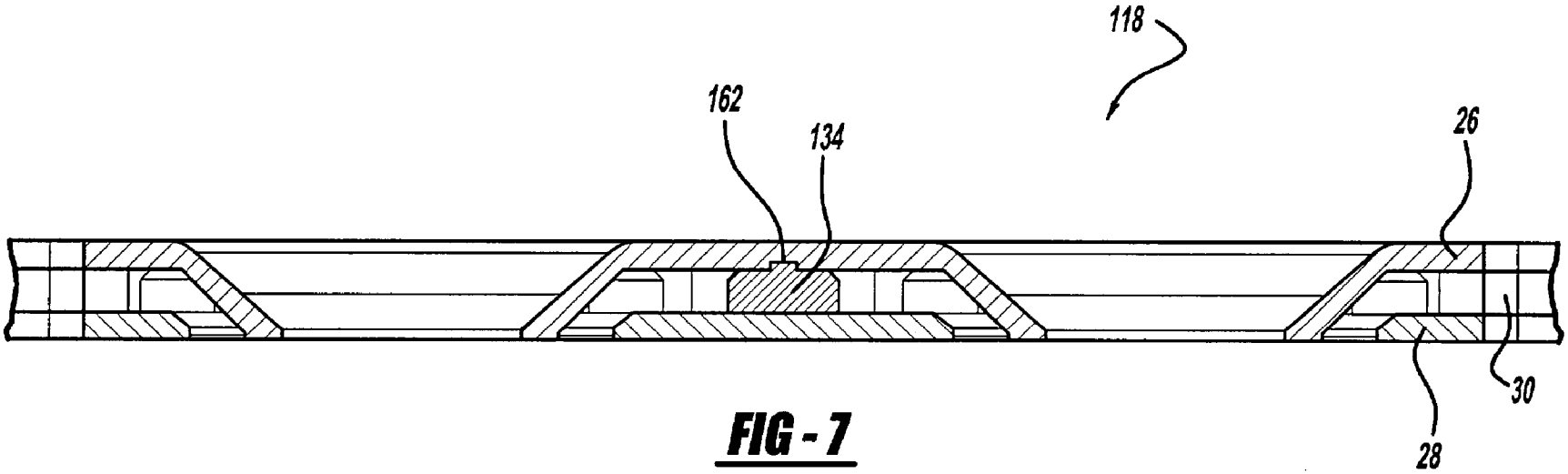
FIG. 7 is a side cross-sectional view of a unique valve plate assembly in accordance with another embodiment of the present invention.

Referring now to FIG. 7, a valve plate assembly 118 in accordance with another embodiment of the present invention is illustrated. Valve plate assembly 118 is the same as valve plate assembly 18 except that center spacer 34 has been replaced with center spacer 134. Center spacer 134 is located at the same position as center spacer 34 which is at approximately the geometric center of valve plate assembly 118. This places center spacer 134 generally midway between both the length and width of valve plate assembly 118 or the same position as shown for center spacer 34 in FIG. 4. Center spacer 134 extends between upper valve plate 26 and lower valve plate 28 and is received within a bore 162 defined by upper valve plate 26. While illustrated as being received in bore 162 in upper valve plate 26, bore 162 could be located in lower valve plate 28 and center spacer 134 could be reversed from what is illustrated if desired.

Because center spacer 134 is a solid member, center bolt 68 or 168 are not included and thus valve plate gasket 20 does not receive additional compression at its center portion through the tightening of a center bolt. Instead, the additional compressive load applied to the center portion of valve plate gasket 20 is applied by the addition of a center rib similar to extension 170 illustrated in FIG. 6 and by gas pressure from compressed gas which is located in the gas discharge chamber located above valve plate assembly 118. Compressed gas at discharge pressure exerts a load on upper valve plate 26 and this load is transferred directly to lower valve plate 28 through center spacer 134. In addition, the tightening of bolts 60 exert a load on upper valve plate 26 through the center rib (not shown) and this load is also transferred directly to lower valve plate 28 through center spacer 134. The exerted load on lower valve plate 28 is then exerted on valve plate gasket 20 to provide additional compressive load for valve plate gasket 20 at the center of valve plate gasket 20 to increase the compression of valve plate gasket 20, to produce a more even clamping load throughout the entire valve plate gasket 20 and to improve both the performance and durability of its sealing function. In the prior art where center spacer 134 is not present, the pressure load exerted on upper valve plate 26 is not directly transferred to lower valve plate 28.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A refrigeration compressor comprising a compressor body defining a first and a second compression cylinder;

a compressor head attached to said compressor body; and a valve plate assembly disposed between said compressor head and said compressor body, said valve plate assembly comprising:

an upper valve plate;

a lower valve plate;

an annular spacer disposed between said upper and said lower valve plate, said annular spacer surrounding said first and second compression cylinders; and a center spacer disposed between said upper and said lower valve plate, said center spacer being located between said first and said second compression cylinders at approximately a geometric center of said valve plate assembly.

2. The refrigeration compressor according to claim 1 wherein said center spacer is disposed on a line which extends between a geometric center of said first compression cylinder and a geometric center of said second compression cylinder.

3. The refrigeration compressor according to claim 2 wherein said center spacer defines a through bore.

4. The refrigeration compressor according to claim 1 wherein said center spacer defines a through bore.

5. The refrigeration compressor according to claim 1 wherein said center spacer defines a through bore concentric with a hole extending through said upper plate and a hole extending through said bottom plate.

6. The refrigeration compressor according to claim 5 further comprising a bolt extending through said hole in said upper plate, through said through bore and through said hole in said bottom plate, said bolt being threadingly received by said compressor body.

7. The refrigeration compressor according to claim 6 wherein said center spacer is disposed on a line which extends between a geometric center of said first compression cylinder and a geometric center of said second compression cylinder.

8. The refrigeration compressor according to claim 1 wherein said center spacer is disposed within a hole defined by said lower valve plate.

9. The refrigeration compressor according to claim 8 wherein said center spacer is disposed on a line which extends between a geometric center of said first compression cylinder and a geometric center of said second compression cylinder.

10. The refrigeration compressor according to claim 1 wherein said center spacer is disposed within a hole defined by said upper valve plate.

11. The refrigeration compressor according to claim 10 wherein said center spacer is disposed on a line which extends between a geometric center of said first compression cylinder and a geometric center of said second compression cylinder.

* * * * *